United States Patent [19]

Rubin et al.

[11] Patent Number: 4,733,246

[45] Date of Patent: Mar. 22, 1988

[54] PLASTIC ANTENNA STRUCTURE HAVING A LAMINATED REFLECTOR

[75] Inventors: Jacob C. Rubin, Rochester; Hans P. Baumeister, Churchville, both of N.Y.

[73] Assignee: Eastman Kodak Company, Rochester, N.Y.

[21] Appl. No.: 777,986

[22] Filed: Sep. 20, 1985

[51] Int. Cl.[4] ..... H01Q 15/16

[52] U.S. Cl. ..... 343/912; 156/245; 264/241

[58] Field of Search ..... 343/912; 156/243; 264/109; 428/380

[56] References Cited

U.S. PATENT DOCUMENTS

| | | | |
|---|---|---|---|
| 2,444,533 | 7/1948 | Richardson | 264/1.9 |
| 3,169,311 | 2/1965 | Small et al. | 343/912 X |
| 3,251,908 | 5/1966 | Wilenius et al. | 264/1 |
| 3,587,098 | 6/1971 | Gosnell | 343/915 |
| 3,716,869 | 2/1973 | Gould, Jr. et al. | 343/912 X |
| 3,840,417 | 10/1974 | Yager | 156/242 |
| 4,154,788 | 5/1979 | Hockensmith et al. | 264/554 |
| 4,171,563 | 10/1979 | Withoos | 29/600 |
| 4,188,358 | 2/1980 | Withoos et al. | 343/912 X |
| 4,255,364 | 3/1981 | Talbert | 264/1.9 |

OTHER PUBLICATIONS

Dow Technical Data, "XD-30600.00 Formable Metallized Plastic for Electromagnetic Interference Shielding", Dow Chemical Co., Oct. 20, 1981.

*Primary Examiner*—Daniel M. Yasich

*Attorney, Agent, or Firm*—Robert F. Cody

[57] ABSTRACT

An antenna reflector is disclosed having a laminated reflector surface bonded to a rigid molded support structure. The reflector surface is thermoformable and has at least one metallized layer that is "sandwiched" between two plastic layers. The forming of the antenna reflector is accomplished in a single molding operation.

1 Claim, 3 Drawing Figures

| THICKNESS |
|---|
| .10 |
| .00025 |
| .08 |
| .41 |

PLASTIC ANTENNA STRUCTURE HAVING A LAMINATED REFLECTOR

FIELD OF THE INVENTION

This invention relates to antenna reflectors for reflecting electromagnetic radiation. More particularly, the invention relates to antenna reflectors constructed primarily of plastic materials.

DESCRIPTION RELATIVE TO THE PRIOR ART

With recent advances in communciation satellite technology, it is now possible for earth stations to receive satellite transmissions with an antenna having a diameter of only 60 cm. Such a small antenna size will make the direct reception of satellite transmissions more attractive to the general public thus creating a need for an inexpensive, light weight antenna reflector that can be easily and economically manufactured.

Antenna reflectors currently manufactured for home use are generally composed of formed metal sheets or glass/cloth laminated layers. Antenna reflectors formed of metal sheets, however, are expensive to manufacture to desired tolerances and reflectors made from glass/-cloth laminated layers are time consuming and labor intensive to produce. Both of the aforementioned reflectors are not particularly well suited for high volume production and are, therefore, too expensive for the average consumer.

A solution would be an antenna reflector structure composed almost entirely of plastic materials that could be easily mass produced in a single molding operation. Attempts at making such a reflector have been made previously. U.S. Pat. No. 3,251,908 discloses a method of making a parabolic reflector utilizing the pressure difference in two chambers to deform a thin plastic membrane. The plastic membrane is coated with an aluminum film and clamped in place between two chambers. A first and second liquid are pumped into the chambers, the first liquid being a hardenable plastic material, which creates a pressure differential between the two chambers that elastically deforms the membrane. The plastic membrane remains attached to the liquid plastic material after the plastic material has hardened. The elastic deformation of the membrane, however, results in internal stress being present when the membrane is bonded to the hardened plastic material. The internal stress may cause the plastic membrane to peel from the hardened plastic or to tear during the deformation.

U.S. Pat. No. 4,171,563 discloses a method of making an antenna reflector using a metal foil in place of a plastic membrane in an attempt to prevent tearing during deformation. Athough the metal foil is less likely to tear during deformation, the metal foil still has a tendency to peel from its support structure. In order to promote proper adhesion of the foil to the support structure, the surface of the metal foil must have a rough surface which requires an additional chemical etching process. The metal foil is also more expensive, difficult to work with and must be protected from the environment which requires that the reflector surface be coated.

Other art which may be of interest in relation to the present invention may be found in U.S. Pat. No. 4,154,788.

SUMMARY OF THE INVENTION

Whereas the prior art teaches the use of a metal coated plastic membrane or metal foil to use as the reflector surface of an atenna reflector, the invention overcomes the deficiencies of the prior art by utilizing a thermoformable plastic/metal/plastic laminated material for the reflector surface. The laminate can be formed and bonded to a rigid molded support structure in a single operation. The thermoformable laminate material provides superior bonding to the support structure because it is not subjected to the same degree of stress relaxation found in elastically deformed materials.

In a presently preferred embodiment of the invention, by limiting the f/d ratio (focal length/diameter) of the reflector to not less than about 0.4 such reflector is formed with excellent bonding of the laminate material to the polyurethane support without the use of adhesives. The electromagnetic metal reflection layer is "sandwiched" (i.e. located) between the plastic layers of the laminate material and is protected from environmental conditions, eliminating the need for a further protective coating.

With the above as background, reference should now be made to the following figures for a detailed description of the invention:

DETAILED DESCRIPTION

Figure 1:
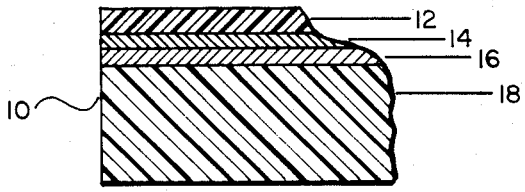
FIG. 1 is a cross section of a plastic/metal/plastic laminate material.

Referring now to FIG. 1, a cross-sectional view of a plastic/metal/plastic laminate material 10 used for the reflector surface is shown. The laminate material 10 is composed of a polycarbonate carrier film 12 on which is deposited (for example by vacuum or vapor deposition) a metal layer 14. Aluminum or any other metal or alloy having the desired reflective properties may be used for metal layer 14. The metallized carrier film is then laminated with an adhesive 16 to an ABS plastic support 18. (Plastic/metal/plastic laminates suitable for use as laminate material 10 are commerically available, for example, XD-30600.00 Formable Metallized Plastic available from the Dow Chemical Co.).

Figure 2:
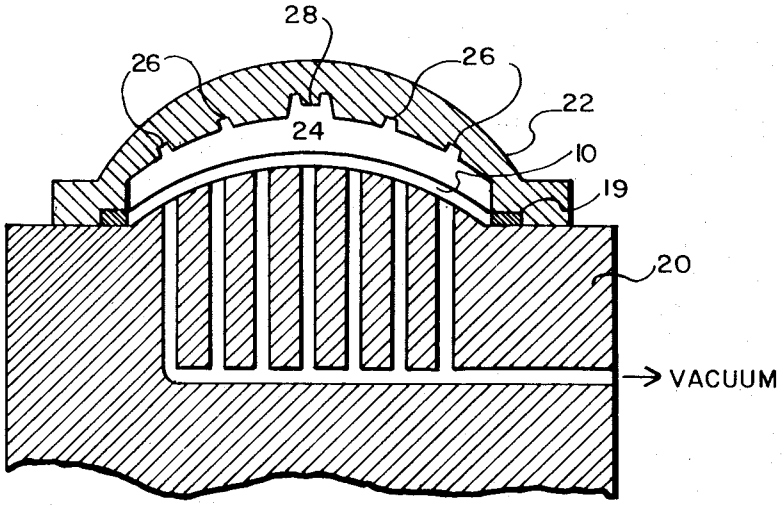
FIG. 2 is a cross section of a molding tool used to form the antenna reflector.

Referring to FIG. 2, the laminate material 10 is preheated, clamped in retainer ring 19 and vacuum formed on a forming tool 20 having a convex surface. A support structure mold 22, having a concave chamber 24, is lowered onto forming tool 20 and secured thereto. The concave chamber 24 has recesses 26 and 28 cut into the mold 22. The recesses 26 provide support ribs 27; and recess 28 provides for a mounting bracket 29 on the completed antenna structure (FIG. 3).

Figure 3:
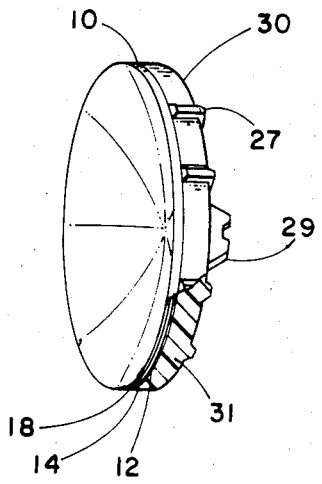
FIG. 3 shows in perspective, a partially exposed view of the finished antenna reflector.

Reaction injection molding (RIM) is used to fill the chamber 24 with a polyurethane material 31 (for example Baydur 726 available from Mobay Chemical Corporation) that bonds with carrier layer 12 of the laminate material 10 and forms a rigid support structure 30 for the formed laminate material 10 as shown in FIG. 3. As indicated above, the reflector surface 10 can be bonded successfully to the rigid support structure 30 for a reflector having a f/d ratio as low as about 0.4 without the use of adhesives between the reflector surface 10 and the support structure 30. Were the reflector to have a lower f/d ratio, for the presently preferred embodiment, the metal layer 14 would tend to develop hairline cracks, thereby possibly causing electrical "hot spots" on the antenna reflector surface. Thermoforming the reflector surface 10 results in less stress relaxation in the reflector surface 10 compared with plastic deformation and prevents the surface from peeling from the support structure 30.

The electromagnetic reflective metal layer 14 is "sandwiched" between the carrier layer 12 and the support layer 18. The finished antenna reflector, therefore, does not require any type of finishing operation to protect the metal layer 14 from environmental conditions.

The invention has been described in detail with particular reference to certain preferred embodiments thereof, but it will be understood that variations and modifications can be effected within the spirit and scope of the invention. For example a liquid resin could be used to form the support structure 30 instead of the polyurethane RIM material.

What is claimed is:

1. Antenna reflector comprising:

(I) a thermoformable laminate material having at least one reflective metallic layer disposed between two plastic layers, and (II) a support structure molded onto said laminated reflector, wherein:

(a) one of said two plastic layers comprises a plastic film, (b) said one reflective metallic layer comprises a reflective metallic layer deposited on said plastic film, (c) the other of said two plastic layers comprises a plastic support layer bonded to said metallic layer, and (d) said reflector is generally parabolically shaped with a ratio of focal length divided by diameter (f/d) of not less than about 0.4 so as to reduce stress in said reflective metallic layer.

* * * * *